United States Patent [19]

Shoesmith

[11] Patent Number: 4,699,542

[45] Date of Patent: Oct. 13, 1987

[54] COMPOSITION FOR REINFORCING ASPHALTIC ROADS AND REINFORCED ROADS USING THE SAME

[75] Inventor: Roy Shoesmith, Midland, Canada

[73] Assignee: Bay Mills Limited, Midland Div., Midland, Canada

[21] Appl. No.: 752,563

[22] Filed: Jul. 8, 1985

Related U.S. Application Data

[63] Continuation-in-part of Ser. No. 711,479, Mar. 13, 1985, abandoned.

[51] Int. Cl.[4] ..... E01C 11/16

[52] U.S. Cl. ..... 404/82; 404/73; 404/28; 404/70; 428/268; 428/489; 52/309.16

[58] Field of Search ..... 404/18, 28, 45, 70, 404/73, 82; 52/309.13, 309.16; 264/35; 428/268, 489

[56] References Cited

U.S. PATENT DOCUMENTS

| | | | |
|---|---|---|---|
| 2,115,667 | 4/1938 | Ellis | 404/70 |
| 2,139,816 | 12/1938 | Fordyce | 404/70 |
| 2,811,906 | 11/1957 | Chappel | 404/73 |
| 3,344,608 | 10/1967 | McEachran | 404/70 X |
| 3,547,674 | 12/1970 | Draper et al. | 428/489 X |
| 3,557,671 | 1/1971 | Vasiloff | 404/28 X |
| 4,168,924 | 9/1979 | Draper et al. | 404/70 |
| 4,219,603 | 8/1980 | Thun | 428/489 X |
| 4,291,086 | 9/1981 | Auten | 428/489 X |
| 4,362,780 | 12/1982 | Marzocchi et al. | 428/489 |
| 4,368,228 | 1/1983 | Gorgati | 428/489 X |
| 4,472,086 | 9/1984 | Leach | 404/70 X |

FOREIGN PATENT DOCUMENTS

| | | |
|---|---|---|
| 1759133 | 6/1971 | Fed. Rep. of Germany . |

OTHER PUBLICATIONS

"Glasgrid", Bay Mills Ltd., Mar., 1986.

"Roadglas", Owens Corning Fiberglas, Highway Products, Road Repair System, Jan., 1983 and Oct., 1982.

*Primary Examiner*—Stephen J. Novosad

*Assistant Examiner*—John F. Letchford

*Attorney, Agent, or Firm*—Fitzpatrick, Cella, Harper & Scinto

[57] ABSTRACT

A reinforcing semi-rigid, resin impregnated continuous filament fiberglass grid is incorporated into a paved road or surface to provide increased strength and resistance to cracking.

2 Claims, No Drawings

COMPOSITION FOR REINFORCING ASPHALTIC ROADS AND REINFORCED ROADS USING THE SAME

This is a continuation-in-part of U.S. application Ser. No. 711,479, filed Mar. 13, 1985 now abandoned.

BACKGROUND OF THE INVENTION

1. Field of the Invention

This invention relates to reinforcing roadways with a prefabricated reinforcing composite, and primarily to reinforcing asphaltic concrete overlays on Portland concrete or other underlying pavements to prevent cracks and other defects, which had previously appeared in the underlying pavement, from reappearing in the overlay. Thermal expansion or contraction is the primary cause of such cracks in the underlayment reappearing in the overlay. This phenomena is generally referred to as "reflective" cracks. The prefabricated reinforcing composite is a resin-impregnated, semi-rigid, open grid of continuous fiberglass filaments. The crosswise and lengthwise intersections of the grid are stitched together or otherwise fixedly connected. In use, the underlying pavement is coated with an asphaltic tack-coat; the semi-rigid, open grid of this invention is then unrolled over the tack-coat; and an asphaltic mixture overlay is applied. Composites of asphaltic materials and fiberglass have shown superior resistance to reflective cracking and other defects.

2. Description of the Prior Art

Various methods and composites for reinforcing asphaltic roads and overlays have been proposed. U.S. Pat. No. 2,115,667 of Ellis (1937) refers to the use of flexible, woven, tape-like strips or ribbons of fiberglass, ½" to 1" wide, which are interwoven at right angles to produce a netting with openings ranging from one to three inches square. These interwoven, flexible tapes are laid on a bed of asphalt and tied together at their intersections by means of wire staples. Another layer of molten asphalt is laid on top of the tapes, followed by crushed stone and a top coat of asphalt. The art has also used narrow strips (4 to 44 inches wide) of a loosely woven fabric made of flexible fiberglass roving (weighing 24 ounces per square yard) in the repair of cracks in pavement. These are not impregnated with resin, and do not have grid-like openings. They are laid down on top of a tack coat, followed by application of asphaltic concrete, but they are too expensive and too flexible to be practical to lay over substantial portions of a roadway and, because of their flexibility, like the unimpregnated structures of Ellis, would be difficult to handle if installed over substantial portions of a road where they could be subjected to traffic from paving vehicles and personnel as the overlayment is put down. Also the lack of adhesion between underlayment and overlying layers is a problem because of the essentially closed nature of the fabric.

Also in the prior art are rigid plastic grids, such as shown in U.S. Pat. No. 4,168,924. These have the disadvantage that they cannot be continuously unrolled and are therefore difficult to install, and while they may use fiberglass as a filler for the plastic, they do not have the strength and other desirable characteristics of continuous filament fiberglass strands.

SUMMARY OF THE PRESENT INVENTION

In making, maintaining and repairing paved roads and surfaces, particularly when placing an asphaltic concrete overlayment on top of an older pavement which has cracked, a tack coat of emulsified asphalt, liquid asphalt, or hot asphalt may be applied to bind the underlying layer of pavement, which may or may not be asphalt based, to a layer of asphalt mixture pavement. An asphaltic mixture, typically consisting of hot mix, or hot laid asphaltic concrete may then be laid down continuously using paving equipment designed for the purpose.

In this invention a prefabricated resin impregnated, semi-rigid, open grid of continuous filament fiberglass strands is placed on top of the tack coat and thereafter buried and imbedded in the roadway under the asphaltic concrete overlayment. Incidentally, the words "roads" and "surfaces" are used here in a broad sense to include sidewalks, driveways, parking lots and other such paved surfaces.

The grid is formed of continuous filament rovings of fiberglass. We prefer ECR or E glass rovings of 2200 tex, though one could easily use weights ranging from about 1000 to about 5000 tex. These rovings are formed into grids with rectangular or square openings, preferably ranging in size from ¾" to 1" on a side, though grids ranging from ⅛" to six inches on a side may be used. The grids are preferably stitched at the intersections of the crosswise and lengthwise strands to hold the grid shape, prevent the rovings from spreading out unduly, and to preserve the openings, which are believed to be important in permitting the overlayment to bind to the underlying layer and thereby increase the strength of the composite. At the same time, it makes possible the use of less glass per square yard and therefore a more economical product; for example, we prefer to use a grid of about 8 ounces per square yard, though 4 to 18 ounces per square may be used, but some prior art fabrics had fabric contents of about 24 ounces of glass per square yard.

While we prefer stitching these intersections together on warp-knit, weft-insertion knitting equipment using 70 to 150 denier polyester, other methods of forming grids with fixedly-connected intersections may be utilized. For example, a non-woven grid made with thermosetting or thermo-plastic adhesive may provide a suitable grid.

Once the grid is formed, an asphaltic coating or resin is applied to impart a semi-rigid nature to it. This coating also makes the grid compatible with asphalt and protects the glass from corrosion by water and other elements in the roadway environment. In drying, the rovings may be flattened, but the grid-like openings are maintained. For example, in a preferred embodiment using 2200 tex rovings, a rectangular grid was formed, with openings of about ¾ inch by one inch, and the rovings flattened to about 1/16 inch to ⅛" across. The thickness of the rovings after coating and drying was about 1/32" or less.

Many resins can be used for this purpose, such as asphalt, rubber modified asphalt, unsaturated polyesters, vinyl ester, epoxy, polyacrylates, polyurethanes, polyolefines, and phenolics which give the required rigidity, compatibility, and corrosion resistance. They may be applied using hot-melt, emulsion, solvent, or radiation-cure systems. One curing system used for a coating and found satisfactory was thermally cured.

For example, a 50% solution of 120°–195° C. (boiling point) asphalt was dissolved in a hydrocarbon solvent using a series of padding rollers. The material was thermally cured at 175° C. and a throughput speed of 30 feet/min. The pick-up of asphalt material was 10–15% based on original glass weight.

The grid when coated is semi-rigid and can be rolled-up on a core for easy transport as a prefabricated continuous component to the place of installation, where it is rolled out continuously for rapid, economical, and simple incorporation into the roadway. For example, it can be placed on rolls 15 feet wide containing a single piece 100 yards or more long, which makes it practical to use this grid on all or substantially all of the pavement surface, which is cost effective because it reduces labor costs. (Where cracks occur in random fashion, mechanized laying of narrow strips of fabric is impossible, and it is costly to place narrow strips over each crack by hand.)

The above described reinforcement invention can be rolled out on a roadway which has previously been coated with tack coat. Once laid down it is sufficiently stable, prior to placing the overlayment on it, for vehicles and personnel to drive or walk on it without displacing it. The large grid openings permit the asphalt mixture to encapsulate each strand of yarn or roving completely and permit complete and substantial contact between underlying and overlaid layers. The product has a high modulus and a high strength to cost ratio, its coefficient of expansion approximates that of road construction materials, and it resists corrosion by materials used in road construction and found in the road environment, such as road salt.

EXAMPLE 1

A warp knit, weft inserted structure was prepared using 2200 tex rovings of continuous filament fiberglass in both the machine direction and the cross-machine, each filament being about twenty microns in diameter. These rovings were knit together using 70 denier continuous filament polyester yarn into a structure having openings of 25 millimeters ("mm") by 12.5 mm. Weft yarns were inserted only every fifth stitch. The structure was thereafter saturated using a padding roller equipped to control nip pressure with a 50% solution of asphalt (Gulf Oil Company designation PR-61) dissolved in high boiling point aliphatic cut hydrocarbon solvent and thermally cured at 175° C. on steel drums using a throughput speed of 30 feet per minute. This thorough impregnation with asphalt serves to protect the glass filaments from the corrosive effects of water, particularly high pH water which is created by the use of salt on roads, and to reduce friction between the filaments, which can tend to break them and reduce the strength of the yarn. The asphalt pickup was about 10 to 15% based on the original glass weight. The resulting grid weighed about 300 grams per square meter and had a tensile strength across the width of 100 kiloNewtons per meter and across the length of 50 kiloNewtons per meter. The modulus of elasticity was about 10,000,000 pounds per square inch, and the grid could be rolled and handled with relative ease.

This grid was applied in the following manner to an asphaltic concrete road surface which had significant cracking but was structurally sound. Normal surface preparation was performed, including base repairs, crack sealing, and pothole filling. Before the grid was laid a uniform tack coat of CRS-1 ("Cationic Rapid Set") emulsified asphalt was applied at the rate of 0.55 liters per square meter using a fixed spray bar distributor. (In the case of older, open surfaces this amount may be increased, for example to 0.75 liters per square meter.) After the initial "break" in the tack coat (that is, after it had set), the grid was unrolled into place and shortly thereafter about 50 mm of HL 1 asphaltic concrete was applied using conventional equipment and techniques.

The resulting reinforcement layer with the reinforcing grid was effective in reducing the occurrence of reflective cracks in the overlay. It is believed that the high strength and modulus imparted to the overlay by the glass grid of this invention acted to disperse the forces which otherwise would have caused reflective cracks. The reinforcement thus tended to prevent these reflective cracks from breaking through the new surface. Measurements of the modulus of rupture of the road indicate that the grid and overlayment of this invention increased the measured modulus of rupture of the overlay from 90 pounds to 230 pounds. Other measurements confirm that inclusion of the grid of this invention generally increases the modulus of rupture by a factor of about 2.5 to 3. In addition, in this example a normal overlay without grid would have used about 75 mm of asphaltic concrete, whereas with the grid only 50 mm was used, and as little as 30 mm of asphaltic concrete may be used.

EXAMPLE 2

An asphalt saturated grid structure as described above may be applied to a rigid pavement (Portland Cement Concrete) as follows. An asphaltic concrete leveling course is applied to a minimum thickness of about 25 to 30 mm using conventional equipment, materials and procedures. Next, a CRS-1 tack coat is applied at a rate of about 0.55 liters per square meter. When the tack has set, the fiberglass grid of this invention is laid and shortly thereafter a minimum of 30 mm of asphaltic concrete is applied in the conventional manner as a top course.

EXAMPLE 3

The asphaltic material applied to the glass grid during manufacture as described in Example 1 or 2 may contain a minor proportion of one or more materials which, after saturation in the strands of the grid, (a) reduce internal friction between adjacent filaments in the strands or otherwise provide internal lubrication to the filaments, and/or (b) permit the grid to remain flexible at low temperatures—temperatures at which asphalt alone would become brittle. For example, styrene butadiene rubber ("SBR") may be added to the asphaltic material applied to the glass grid at about 15% by weight of the asphalt. This mixture serves to provide abrasion resistance to the filaments and reduces fracture of individual filaments in the strands of the grid which may be caused by their rubbing against each other primarily during installation but also after being embedded in the road. This mixture also makes the reinforcing composite less brittle at low temperatures, such as may be encountered in the roadway after installation, and avoids loss of strength which may be caused by such brittleness.

I claim:

1. A process for reinforcing roadways in which (a) an underlying layer of pavement is covered by an asphaltic tack coat, (b) an impregnated, semi-rigid, open, elongated grid consisting essentially of two sets of parallel, straight continuous filament fiberglass strands, one set extending lengthwise and one set extending crosswise with respect to the elongated direction of the composite, is laid on top of the tack coat oriented such that the lengthwise set of parallel strands is parallel to the direction of the roadway, said strands being fixedly connected at their intersections before the composite is impregnated, and said impregnating material having been applied to the grid before the grid is placed on the underlying layer of pavement, and (c) a layer of asphaltic mixture is spread on top of the grid.

2. The process of claim 1 in which the grid is made by a warp-knit, weft-insertion knitting method.

* * * * *